US005827126A

United States Patent [19]

Lee

[11] Patent Number: 5,827,126

[45] Date of Patent: Oct. 27, 1998

[54] GOLF PUTTING PRACTICE DEVICE

[76] Inventor: Do W. Lee, 1808 Daeyeon-Dong, Daeyeonsamikbeach Apt. 105-1103, Nam-Ku, Pusan, Rep. of Korea

[21] Appl. No.: 852,598

[22] Filed: May 7, 1997

[30] Foreign Application Priority Data

Dec. 31, 1996 [KR] Rep. of Korea ..... 1996-82500

[51] Int. Cl.[6] ..... A63B 69/36

[52] U.S. Cl. ..... 473/213; 473/276

[58] Field of Search ..... 473/213, 276, 473/201, 202, 205, 207, 212

[56] References Cited

U.S. PATENT DOCUMENTS 3,606,342 9/1971 Albertson, Jr. .
4,193,065 3/1980 Bittner .
5,199,712 4/1993 Hoyle, Jr. et al. .
5,324,038 6/1994 Sasser .
5,423,547 6/1995 Puso .
5,435,547 7/1995 Lee .
5,509,809 4/1996 Clay .
5,511,788 4/1996 Manley et al. .
5,607,361 3/1997 Mastandrea ..... 473/213

*Primary Examiner*—George J. Marlo
*Attorney, Agent, or Firm*—Birch, Stewart, Kolasch & Birch, LLP

[57] ABSTRACT

A golf putting practice device which is adapted to be worn on the wrist of the user, which includes a housing containing an alarm system including a sensor, an operating lever pivotally connected to the housing and biased in a predetermined neutral position, a switch lever fixed at one end to the operating lever in the neutral position and extending into the housing in close proximity to the sensor, whereby when the operating lever and associated switch lever are moved from the neutral position, as a result of a bending of the wrist, the switch lever engages the sensor which activates the alarm system, which signals the bending defect in the putting stroke.

7 Claims, 3 Drawing Sheets

GOLF PUTTING PRACTICE DEVICE

BACKGROUND OF THE INVENTION

1. Field of the Invention

The present invention relates to a golf putting practice device for training and practicing the putting of a golf ball with more accuracy, and more particularly, to a device for monitoring and correcting errant wrist movements during the putting of a golf ball or during the swinging of a golf club.

2. Description of the Related Art

Various types of practicing devices for training and practicing the putting of a golf ball are well known in the art. Generally, the correct golf swing is a set of highly complex body movements which require precise coordination of the hands, wrists, arms, shoulders, torso, hips, legs, and knees of the golfer. While the motion of each part of the body is important as the body of the golfer coils and uncoils, a lack of a proper wrist position during the golf swing or during golf putting is particularly important.

Conventional golf putting practice devices which are presently utilized comprise a guide member consisting of a flat rectangular-shaped base and a pair of elongated, vertically spaced apart and parallel side rails. The present inventor has thus developed an improvement in the golf putting practice device as disclosed in U.S. Pat. No. 5,435,547 entitled "Golf Putting Practice Device."

Also, conventional golf swing training devices for controlling the range of wrist movement or arm movement disclosed in U.S. Pat. No. 3,606,342, U.S. Pat. No. 4,193,065, U.S. Pat. No. 5,199,712, U.S. Pat. No. 5,324,038, U.S. Pat. No. 5,423,038, U.S. Pat. No. 5,509,809, and U.S. Pat. No. 5,511,788.

However, such conventional golf putting practice devices suffer from a number of problems, that is, even though they show putting in a direction at right angles to the direction the putter is facing, they do not disclose wrist angle control during golf putting. Thus, though it is shown that wrist control is important in a golf swing, the importance of wrist control while putting is not emphasized. Also, it is difficult for a user to perceive and confirm immediately and automatically when the wrist moves during putting, and any such devices used for this purpose are complicated and expensive to manufacture.

SUMMARY OF THE INVENTION

Therefore, it is an object of the present invention to provide a device which can be used to practice the putting stroke and eliminate the problems encountered with conventional golf putting practice devices.

Another object of the present invention is to provide a golf putting practice device which includes a housing having a wrist band for attaching or detaching the device to the wrist, a battery, a sensor, an alarm disposed within the housing, and an operating lever attached to the back of the band containing a switch lever which is operatively connected to the sensor. When the switch lever with the operating lever is pivotally moved by the moving of the wrist during the putting stroke, the alarm is initiated because the switch lever engages the sensor. Thus, wrist movements during the putting stroke can be corrected.

A further object of the present invention is to provide a golf putting practice device which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a golf putting practice device which includes a housing having a wrist band for attaching or detaching the device to the wrist and containing a battery, a sensor, an alarm, and an operating lever slidably attached to the back of the hand. The operating lever contains a switch lever provided at one end thereof for operatively engaging the sensor, whereby when the user putts a golf ball, if the wrist angle changes during the putting stroke, the alarm sounds so that errant wrist movements can be corrected.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Referring now in detail to the drawings for the purpose of illustrating preferred embodiments of the present invention, the golf putting practice device as shown in FIGS. 1, 2, 3, and 4, comprises a housing 1 having a wrist band 6 for attaching or detaching the device to the wrist, and a cover 2 for enclosing the housing 1.

Figure 4:
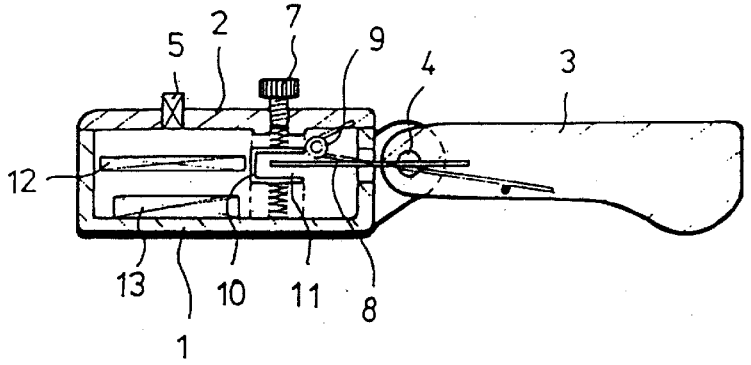
FIG. 4 is a sectional view of the golf putting device according to the present invention.

The housing 1 includes a sensor 10 having a C-shaped configuration which defines an opening 11 for receiving the switch lever. An alarm 12 and a battery are connected to the sensor 10. An operating lever 3 is pivotally connected to the housing 1 through a pair of pivot pins 4 and is biased by a spring 9. A switch lever 8 is secured at one end to the operating lever 3 and the other end thereof is disposed to extend into the open end of mouthpiece 11 of the sensor 10. Thus, the switch lever 8 is pivotally moved with the movement of the operating lever 3 by the pivot pins 4, as shown in FIG. 4.

Figure 7:
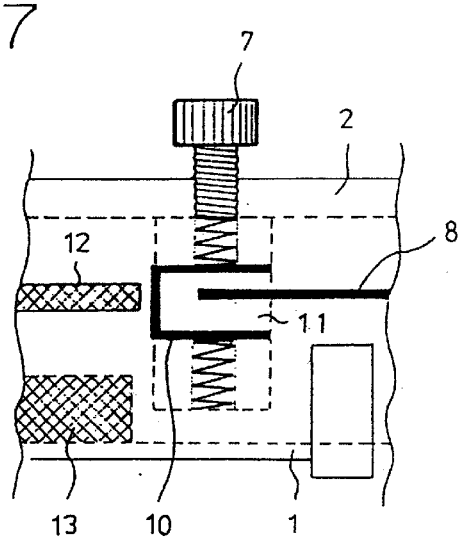
FIG. 7 shows an enlarged schematic diagram of the golf putting practice device according to the present invention showing the construction of the sensor.

The cover 2 includes an on/off switch 5 for actuating or deactivating the golf putting device and an adjust bolt 7 is provided for adjusting the switch lever 8 disposed within the mouthpiece 11 of the sensor 10, in an optimum putting stroke position while the user wearing the present device grasps the golf putter club as shown in FIG. 7.

Figure 1:
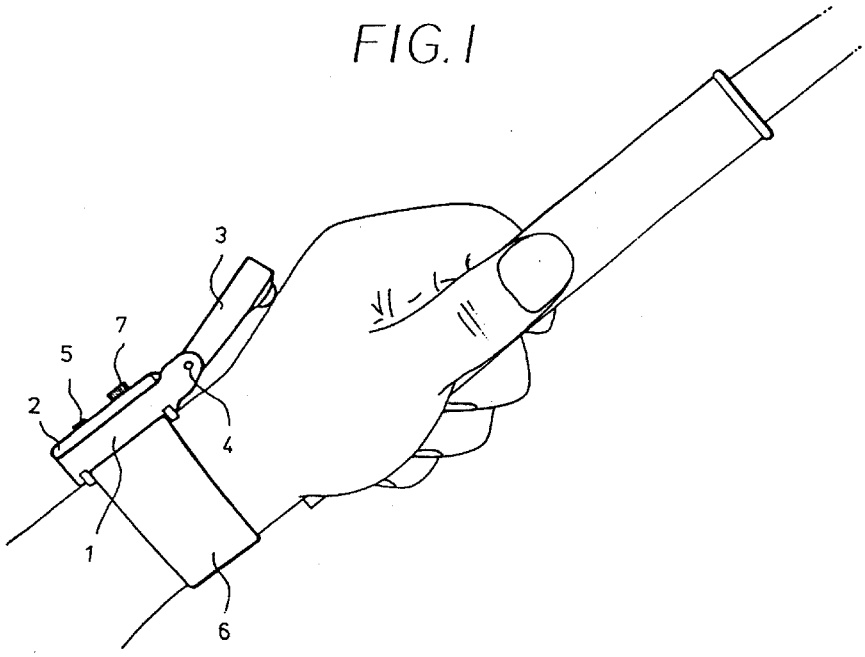
FIG. 1 is a side view of the golf putting practice device according to the present invention, the device being seen as attached to the wrist.
Figure 2:
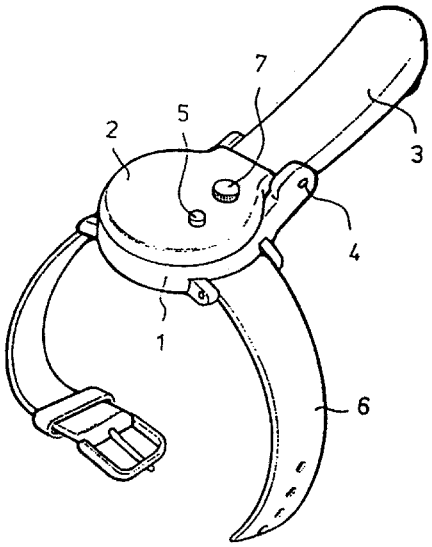
FIG. 2 is a perspective view of the golf putting device according to the present invention.
Figure 3:
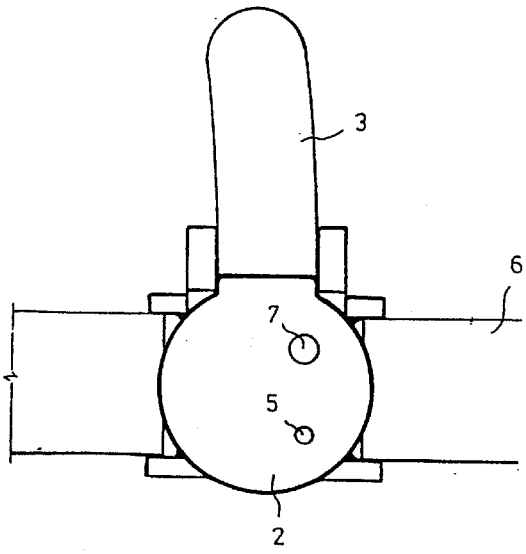
FIG. 3 is a top plane of the golf putting device according to the present invention.

As shown in FIGS. 5 (A), 5 (B), and 5(C), the golf putting practice device according to the present invention operates as follows. First of all, the golf putting practice device of the present invention is strapped on the wrist of a golfer. Secondly, the golfer turns the on/off switch 5 to the "ON" position. Thereafter, when the golfer has assumed a proper address position, the angle of the wrist is locked. At this time, if the alarm actuates, the user adjusts the adjusting bolt 7. The golf putting practice device of the present invention can be readily attached to the back of the hand as shown in FIG. 1.

Figure 5A:
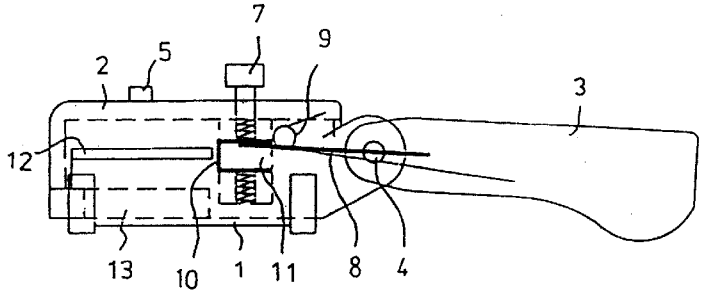
FIG. 5(A) shows a schematic diagram of the golf putting device according to the present invention in which the switch lever is pivoted to a position to allow contact with an upper portion of the sensor which activates the alarm.
Figure 5B:
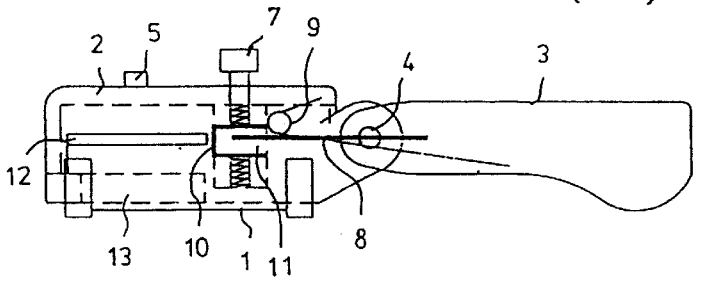
FIG. 5(B) shows a schematic diagram of the gold putting practice device according to the present invention in which the switch lever is locked in a position which prevents it from contacting the sensor, which deactivates the alarm.
Figure 5C:
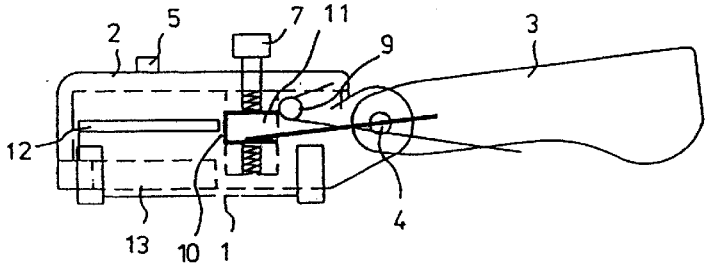
FIG. 5(C) shows a schematic diagram of the golf putting practice device according to the present invention in which the switch is pivoted to a position to allow contact with a lower portion of the sensor, which activates the alarm.
Figure 8:
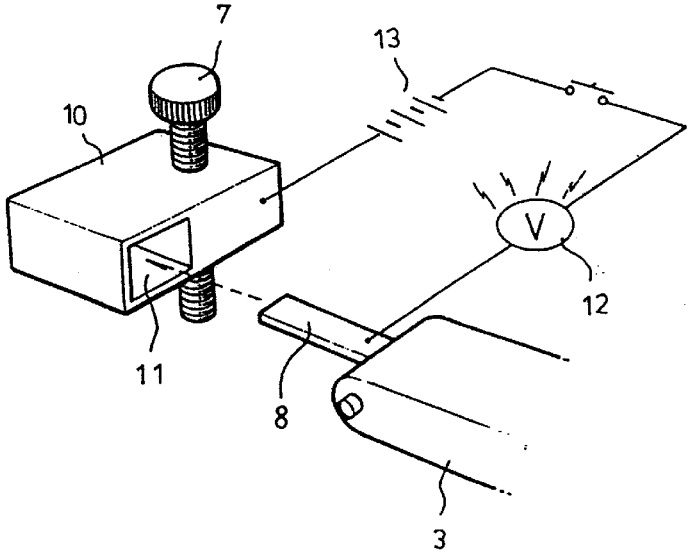
FIG. 8 is an exploded, perspective view of the golf putting practice device according to the present invention.

When the golfer putts a golf ball (not shown), if the angle of the wrist is changed beyond a narrow range, the switch lever 8 disposed within the mouthpiece 11 of the sensor 10 touches the upper portion of the sensor 10 as shown in FIG. 5(A) or the lower portion of the sensor 10 as shown in FIG. 5(C), actuates the alarm which generates a sound, as electrically shown in FIG. 8.

Figure 6:
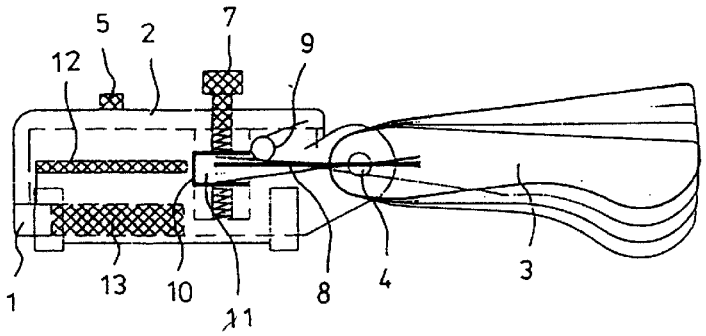
FIG. 6 shows a schematic diagram of the golf putting practice device according to the present invention in which the sensor is continuously activated.

However, if the wrist does not move while the golfer putts a golf ball, the switch lever 8 does not touch the sensor 10, whereby the alarm 12 deactivates and does not generate a sound, as shown in FIG. 5(B). Also, as shown in FIG. 6, the operating lever 3 can move a small distance without causing the switch lever 8 to touch the sensor 10, whereby the alarm 12 does not generate a sound.

Accordingly, the golf putting practice device according to the present invention permits one to develop a natural putting stroke in a simple and efficient manner. Thus, if the golfer's putting stroke moves the angle of the wrist, the golf putting practice device of the present invention will generate a sound by causing the switch lever 8 to engage the sensor 10, thus correcting the putting stroke.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf putting practice device which is adapted to be worn on the wrist of the user, which comprises:

a housing containing an alarm system including a sensor;

an operating lever pivotally connected to said housing and biased in a predetermined neutral position;

a switch lever fixed at one end to said operating lever in said neutral position and extending into said housing in close proximity to said sensor, whereby when the operating lever and associated switch lever are moved from the neutral position, as a result of a bending of the wrist, the switch lever engages the sensor which activates the alarm system which signals the bending defect in the putting stroke.

2. The golf putting practice device of claim 1, wherein a wrist band is attached to the housing for attaching the practice putting device to the wrist.

3. The golf putting practice device of claim 1, wherein the alarm system includes said sensor electrically connected to an alarm and a battery.

4. The golf putting practice device of claim 3, wherein the housing is provided with an on/off switch which is electrically connected to the battery.

5. The golf putting practice device of claim 1, wherein adjusting means are operatively associated with said sensor for varying the distance between the sensor and the switch lever in its neutral position, thereby varying the sensitivity of the device.

6. The golf putting practice device of claim 5, wherein the sensor has a C-shaped configuration which defines an open mouth and the switch lever extends into said open mouth.

7. The golf putting practice device of claim 6, wherein the adjusting means is an adjusting screw which engages the sensor for defining the dimension of the open mouth of the sensor.

* * * * *